United States Patent [19]

Kolze et al.

[11] 4,311,102

[45] Jan. 19, 1982

[54] BURNING SYSTEM

[76] Inventors: Melvin W. Kolze, 10302 Don Pico Rd.; Bruce A. Kolze, 10356 San Carlos Dr., both of Spring Valley, Calif. 92077

[21] Appl. No.: 98,122

[22] Filed: Nov. 28, 1979

[51] Int. Cl.[3] ..... F23K 3/00

[52] U.S. Cl. ..... 110/103; 110/101 C; 110/101 CF; 110/101 CC; 110/101 CD; 110/102; 110/104 R; 110/105; 110/186; 122/449

[58] Field of Search ..... 110/101 C, 101 CF, 101 CC, 110/101 CD, 102, 105, 103, 108, 346, 347, 104 R, 185, 186; 122/449; 431/346, 12, 90; 414/307, 296

[56] References Cited

U.S. PATENT DOCUMENTS

| | | | |
|---|---|---|---|
| 1,456,899 | 5/1923 | Mather | 431/346 |
| 2,376,079 | 5/1945 | Orphan | 110/186 X |
| 2,804,350 | 8/1957 | Vastine . | |
| 3,267,891 | 8/1966 | Hemker | 110/104 R |
| 3,338,434 | 8/1967 | Kolze . | |
| 3,414,142 | 12/1968 | Kolze . | |
| 3,610,182 | 10/1971 | Stockman | 110/102 |
| 3,865,053 | 2/1975 | Kolze et al. | 110/102 |
| 4,030,642 | 6/1977 | Morrison | 222/368 |
| 4,177,740 | 12/1979 | Lamb et al. . | |
| 4,184,436 | 1/1980 | Palm et al. . | |

*Primary Examiner*—Edward G. Favors

*Attorney, Agent, or Firm*—Hill, Van Santen, Steadman, Chiara & Simpson

[57] ABSTRACT

An improved burning system for automatically controllably charging a wood-waste burning steam boiler utilizes a fuel bin unloader having a gravity fed screw metering device for feeding fuel into the system in response to steam demand and pollution output feedback signals. The metering device deposits fuel through a rotary air lock into an air stream of a fuel injection fan having a vortex controller on the inlet side to modulate and maintain a proper fuel-air ratio for wood firing. The fan injects the fuel and air into the boiler through a controlled proportioning valve. All controls and recording devices are contained in one control unit for operating each component of the system to achieve and maintain a proper fuel-air ratio according to received steam demand and pollution output feedback signals.

11 Claims, 1 Drawing Figure

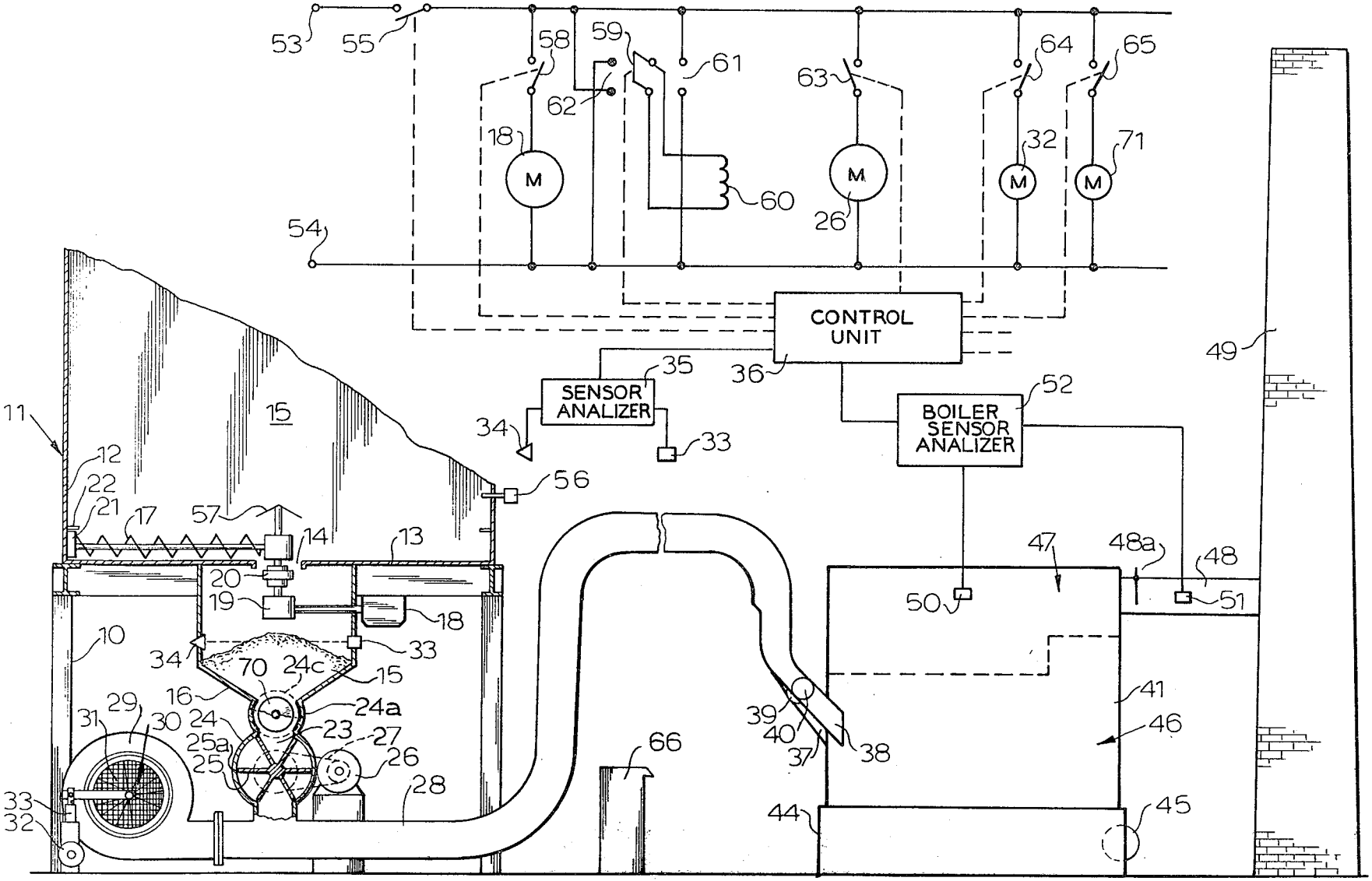
CONTROL UNIT
BOILER SENSOR ANALIZER
SENSOR ANALIZER
M

BURNING SYSTEM

BACKGROUND OF THE INVENTION

1. Field of the Invention

The present invention relates to control systems for charging a steam boiler, and in particular to control systems for charging a wood-waste burning steam boiler in response to steam demand and pollution output.

2. Description of the Prior Art

Large quantities of wood-waste particulate materials, such as saw dust, wood chips, hogged bark, tan bark, and the like are produced in many industries. Disposal of such particulate material in a safe, efficient and pollution-free manner is a problem faced by all such industries. Waste material of this type is generally stored in large containers equipped to discharge the waste material utilizing various unloading mechanisms. Some known bottom unloaders are comprised of a rotating screw-type conveyor having means for driving the conveyor screw around the bottom of the container in a radially sweeping motion. Driving the conveyor screw in this manner forces the conveyor screw through the particulate material regardless of whether the conveyor is moving material at its maximum capacity, thus resulting in less than maximally efficient operation. Such prior art conveyor devices also tend to arch upwardly into the particulate material in the container as a result of the natural tendency of the rotating screw to "climb," ultimately resulting in bending or breaking of the conveyor screw.

A particularly suitable apparatus for unloading particulate material from the bottom of such containers is disclosed and claimed in U.S. Pat. No. 3,414,142 granted to M. W. Kolze (which is incorporated herein by reference). The system disclosed and claimed in U.S. Pat. No. 3,414,142 generally comprises a non arching-radially sweeping conveyor screw for bottom unloading of particulate material from a storage container into a preparatory means which includes a sonic sensor for maintaining an optimum amount of particulate material in the preparatory means. A control system integrated with the charging apparatus controls mixing of the compacted particulate material with a controllable volume of air provided by a blower and also controls damper valves to feed an optimum amount of particulate material-air mixture into a combustion chamber, such as a boiler, for burning therein. The integrated control system receives feedback information relating to critical parameters within the boiler, such as boiler temperature, water supply, and smoke and pollution level and varies the operation of the charging system in accordance with the received feedback information so that an optimum amount of particulate material is fed into the combustion chamber for substantially complete combustion of the material and minimization of pollutants.

A problem in the art is that operation of a conveyor screw below a discharge bin with an overloading of saw dust above such a screw will, because of the tendency of saw dust to compact due to its own weight, result in a self-supporting mass of material which can be tunnelled through by the conveyor screw thus leaving a supporting arch of saw dust above the screw. After the conveyor screw tunnels out the saw dust beneath the supporting arch, no further saw dust will be transported even though a measurement of saw dust levels would indicate that sufficient saw dust is present in the bin. In fact, detection of the problem is possible only after, for example, a saw dust burning machine fed by the empty conveyor screw cycles down for lack of saw dust input. The manual intervention of an operator is then required to dislodge the compacted saw dust.

If too much saw dust or other wood-waste material is supplied into a combustion chamber, incomplete combustion will result and cause extensive and unacceptable smoke, ash and other pollution. If insufficient saw dust is fed into a combustion chamber, however, an inefficient combustion and/or disposal of material occurs.

The same problems are present to a greater or lesser degree with the use of other types of wood-waste materials as fuel.

An apparatus for overcoming some of the above problems is claimed and disclosed in U.S. Pat. No. 3,865,053 granted to B. A. Kolze and M. W. Kolze (which is incorporated herein by reference). That apparatus utilizes the unloader of U.S. Pat. No. 3,414,142 to adjustably control the input of wood-waste material to a conveyor screw which feeds the material to a choke screw which transports a selected amount of material to a selected volume of air from a rotating blade which pulls the material from the choke screw and feeds the mixture into a combustion chamber of a boiler for burning. The system includes control circuitry for integrating the functions of the entire system so that an optimum amount of particulate matter is fed to the combustion chamber.

SUMMARY OF THE INVENTION

The present invention provides an integrated control system for charging a boiler or other fuel-burning system with particulate wood-waste material.

An object of the present invention is to provide an improved combustionable particulate waste product burning system having a fully integrated control system controlling the entire material feed and burning process from a storage container to a combustion chamber. Another object of the present invention is to provide a wood-waste particulate material burning system which includes a sonically controlled material feed meter, a metered feed having a rotary air lock for depositing particulate material into a controllable air stream of a fuel injection fan, which has a vortex controller on its inlet side to modulate and maintain a proper fuel-air ratio, a controlled proportioning valve for monitoring flow of the fuel-air stream into the combustion chamber of a boiler, and sensors for monitoring the steam demand and combustion efficiency of the boiler and the pollutant level of exhaust gases, and controlling operation of the various system elements in accordance with a predetermined program to ensure substantially complete combustion and pollutant minimization.

BRIEF DESCRIPTION OF THE DRAWING

The drawing is a schematic diagram illustrating a system flow and working relationship between various elements of a particulate waste products firing system constructed in accordance with the principles of the present invention.

DESCRIPTION OF THE PREFERRED EMBODIMENTS

An improved particulate wood-waste material burning system is shown in the drawing having a frame 10 which supports a container 11 having a base 13 and a vertical wall 12. The base 13 has an opening 14 therein through which wood-waste material 15 such as saw dust, wood chips, hogged bark, tan bark, and the like can be deposited into a hopper 16.

Controlled transfer of material 15 from the bin 11 to the hopper 16 is achieved by a rotating conveyor screw 17 operated by a motor 18 through a right angle linkage 19 and a rotational linkage 20. The conveyor screw 17 terminates in a wheel 21 having an outer diameter which is larger than the individual flights of the conveyor screw 17, so that the flights remain a distance above the base 13 as the wheel 21 rotates thereon. An annular retaining rim 22, extending perpendicular from the wall 12, restricts the natural tendency of the conveyor screw 17 to rise as it moves through the material 15.

The hopper 16 has an opening 23 in the bottom thereof allowing flow of the material 15 into a generally cylindrical housing 24*a* having a choke screw 70 therein, along with a shroud-like covering 24*c* which compacts and regulates the amount of material carried by screw 70. The choke screw 70 is rotated by a motor (not shown). A limited amount of material 15 is carried by the choke screw 70 to a circular housing 24, insuring that the material is of optimum density for combustion. A controlled volume of material 15 is thereby fed into the path of a plurality of blades 25 preferably terminate in a knife edge 25*a* to cut any larger waste wood pieces into smaller pieces during operation so as to insure that a complete air seal between the blades 25 and the housing 25 is maintained.

Rotation of the blades 25 deposits a predetermined constant volume of particular material 15 into a duct 28, which is connected to a housing 29 containing a blower 30. The material 15 is thus deposited in the air flow of the blower 30, and the blades 25 and housing 24 are constructed in sealed relation forming an air-lock preventing air flow into the housing 24. With the motor 26 providing a selected constant rotational output, the volume of particulate material 15 is deposited into the duct 28 is a known value and the fuel-air mixture can be varied by controlling the operation of the blower 30.

The blower 30 has a vortex input 31 which is adjustable by a motor 32 and a linkage 33 as is known in the art to selectively vary the amount of air intake to the blower 30. Interrelated control of the motors respectively operating the choke screw 70, the rotary feeder (24, 25) and the blower 30, is undertaken to as to achieve an optimum fuel-to-air ratio for the material 15 which is mixed with air in the duct 28.

A further control for monitoring the amount of the particulate material 15 in the hopper 16 is provided in the form of a sonic monitor consisting of a sonic transmitter 33 and a sonic receiver 34. The transmitter 33 and the receiver 34 are positioned in the hopper 16 so that a straight-line transmission therebetween defines a maximum level of material 15 in the hopper 16. The intensity of the sonic energy leaving the sonic transmitter 33 may be adjusted such that when the feed of material 15 from the bin 11 exceeds the level defined by a line between the transmitter 33 and the receiver 34, the material 15 will block transmission of the sonic signal. Alternatively, the intensity of the sonic signal may be increased so that the signal will penetrate the material 15 as long as a selected material density is not present. For example, the signal intensity may be adjusted so that transmission of the signal is not interrupted until substantially the entire area between the transmitter 33 and the receiver 34 is filled with material 15, i.e., the hopper 16 is essentially filled to its outer edges. Such adjustment would prevent the situation where a pile of material 15 exists in the central portion of the hopper 16, yet does not reach the sides of the hopper 16, so that even though the pile would block sonic transmission, there would still be insufficient material 15 in the hopper 16 to facilitate optimum boiler operation.

When the sonic signal transmission is interrupted, a sensor analyzer 35, constructed as is known in the art, will provide a signal to a control unit 36 which will in turn provide a signal to stop the motor 18 and thereby stop the flow of material 15, as more fully explained below.

The duct 28 continues to a boiler 41 where it is divided into two smaller ducts 37 and 38 connected to dual inputs of the boiler 41. Air and material flow through the ducts 37 and 38 occurs through blow-back dampers, schematically shown at 39 and 40, both of which are operated solely by air pressure.

The boiler 41 may comprise any fire tube or water tube boiler or industrial hot air furnace, industrial incinerator or heat-exchanger (heating thermal oil or water or other suitable medium) and can be primarily or supplementarly fired by coal, gas, oil or other available fuel. The firing system for such devices and fuels are known so that further details thereof are unnecessary. In the embodiment shown, the boiler 41 is mounted on a fire brick and steel base 44 and may be equipped with an over-fire manifold 45 or an under-fire manifold (not shown). The boiler 41 has a combustion area 46 and an upper heat-extraction area 47 whereat steam lines or other like may be disposed. Preferably suspension burning is utilized whereby an admixture of air and wood waste material is blown into the boiler and burned at a proper fuel-air ratio, resulting in substantially complete combustion, with virtually no smoke or ash. The boiler 41 has an exhaust duct 48 connected to a stack 49 which may be provided with pollution controls (not shown) such as a fly ash arrester, a scrubber (dry or wet) or other equipment required by local air pollution governing agencies. An additional gas outlet damper 48a may also be provided in the exhaust duct 48 as an aid in heat retention.

The blow-back dampers 39 and 40 also act as a safety device to prevent gases and heat from travelling through the duct 28, should an explosion or other malfunction occur in the boiler 41, because the blow-back dampers 39 and 40 allow air flow only in a direction toward the boiler 41. The rotary air seal between the blades 25 and the housing 24 also acts as a safety feature to further prevent back flow of gases and heat through the duct 28.

A sensor 50 disposed in the area 47 of the boiler 41 monitors steam demand, and a second sensor 51, disposed in the exhaust duct 48, measures combustion efficiency, such as by an $O_2$-analyzer or other combustion analyzer. Both of the sensors 50 and 51 are connected to a boiler sensor analyzer 52 which is connected to the control unit 36 for providing a feedback signal thereto so that various system parameters may be adjusted in accordance with the signals received from the sensors 50 and 51.

The system is connected to a power source at terminals 53 and 54, such as a 60 cycle, 110–120 volt single-phase supply line.

The control unit 36 is activated to initiate the material burning process. The main power supply switch 55 is closed, and a sensor 56 contained in the bin 11 determines whether sufficient material 15 is present to charge the system. As shown in the drawing, the sensor 56 is disposed at a side of the bin 12 to insure that material is present all the way to the edges of the bin 12 by measuring the height or weight of the materials. The control unit 36 will, depending upon the signal received from the sensor 56, either refuse to start the burning process, or activate the process. The control unit 36 may also deactivate the process should the availability of material 15 within the bin 11 become low at any time.

The gear boxes associated with the auger 17 may be covered by a deflector 57.

Once power is provided to the system and the presence of material 15 is detected within the storage bin 11 by the weight sensor 56, the ultrasonic analyzer 36 begins monitoring an ultrasonic signal between the transmitter 33 and the receiver 34. The signal received by the analyzer 35 is analyzed to determine if the desired level of accumulated material 15 is present within hopper 16, as shown in the drawing. If an insufficient level of material 15 is detected, a signal is sent to the control unit 36 which in turn closes a switch 58 which activates the bin unloader motor 18. The ultrasonic sensor analyzer 35 continually monitors the level of accumulated material 15 within the hopper 16 and provides a signal so that the control unit 36 can control the operation of the screw conveyor 17 and maintain a desired level of accumulated discharge.

After receiving the required signal from the sensor analyzer 35 the control unit 36 actuates operation of the blower 30. The vortex intake 31 of the blower 30 can be selectively opened and closed by operation of a double pole switch 59 connected to an induction coil 60, which controls the motor 32. Connection of the switch 59 across a first pair of terminals 61 operates the motor 32 in a first direction, and connection of the switch 59 across a second pair of terminals 62 operates the motor 32 in a second, opposite direction. Other suitable control means may be utilized as are known to those skilled in the art.

The control unit 36 also controls a switch 65 for selectively operating the motor 71 which controls the flow of material 15 from the hopper 16 to the duct 28 through rotary feeder 24.

The entire system is thus operated in response to feedback signals received from the weight sensor 56, the sonic sensor analyzer 35 and the boiler sensor analyzer 52, all connected to the control unit 36 and which may all be contained in a control panel 66.

An example of a system utilizing the inventive concept herein is as follows. It should be understood tha the following description is for exemplary purposes only, and is not intended to represent the only manner in which the concept disclosed herein may be utilized.

In an exemplary burning system which includes a 25,000 pound high pressure boiler operating at about 200 psig the above-described particulate wood-waste storage and feed system may comprise a suitable container 11 which may be a 200 ton metal storage facility resting on a 10 foot high steel frame in the boiler room location. The nonarching, radially sweeping unloader may be of the type disclosed and claimed in U.S. Pat. Nos. 3,338,434 and 3,414,142 and sold under the registered trademark "SHUROUT." The motor 18 may be a 10 horsepower totally enclosed fan cooled (TEFC) unit. The blower 30 will have a vortex controller on the inlet side and modulate to maintain a proper fuel-air ratio for wood firing. A nine inch diameter schedule 40 pipe with long curved 90° radius elbows with removable backs of XAR material may be installed and connected to the boiler 41 by two 7 inch diameters schedule 40 pipes and elbows. The wood firing system may have its own set of combustion controls and recorders as described above and will be pre-wired and mounted on the standing electric control panel 66 with required interlocks. A Breslove type fly ash arrester may be utilized having an induced draft fan with an Eddy drive motor to modulate according to fuel consumption. Cinder re-injection may be installed and connected to the stack 49. The stack 49 may be approximately 36 inches in diameter and 40 feet high. Properly adjusted operation of this system will handle about 200 tons of waste material in a substantially smokeless manner with about 0.15 grains of particulate fallout per cubic foot of flue gas or 0.20 pounds of fallout per million BTU of heat input, producing from about 3,000 to 25,000 pounds of steam per hour.

A second conveyor screw may be installed parallel to the metered feed 70 to remove excess material 15 to a truck or other overflow container to accommodate excess material 15 if for some reason material feed into the housing 24 exceeds the system limits.

Although modifications and changes may be suggested by those skilled in the art it is the intention of the inventors to embody within the patent warranted hereon all such changes and modifications as reasonably and properly come within the scope of their contribution to the art.

We claim as our invention:

1. In a particulate waste product firing system which includes: a combination of a storage container and bottom unloader therefor for particulate material having a central opening in the bottom of said container, a radially free-sweeping non-arching conveyor screw rotatable within said container and operable to unload stored particulate material through said opening; a hopper connected to the bottom of said container and disposed immediately below said central opening for receiving discharged particulate material; a sonic control means mounted in said hopper and operably connected to said conveyor screw to selectively vary an amount of particulate material discharged into said hopper in response to a measured accumulation level of particulate material therein; a duct connecting the hopper to a particulate material burning apparatus having two inputs and an exhaust outlet which leads to a stack, the improvement comprising:

a rotary air seal feed interconnected between an opening in the bottom of said hopper and said duct for depositing particulate material in said duct while maintaining air-sealed relation between said hopper and said duct;

a blower having a variable vortex input, said blower connected to said duct for producing an air stream therein for moving said particulate material through said duct to said particulate material burning apparatus;

a steam demand sensor;

a combustion efficiency sensor disposed in said exhaust outlet for providing a feedstock signal in response to a measured combustion parameter therein; and an integrated control unit receiving signals from said sonic control means, said steam demand sensor, and said combustion efficiency sensor and selectively modulating operation of said screw conveyor through a constant speed rotary seal feed, and modulating operating of said lower vortex intake to provide an optimum mount of particulate material input and air input to provide a particulate material-air input to said burning apparatus for optimum combustion thereof and minimization of pollutants.

2. The improvement of claim 1 including a detector disposed in said container to detect a volume of particulate material therein, said detector connected to said control unit for providing a feedback signal thereto, and said control unit provided with means for disconnecting said system from a power supply if said volume falls below a predetermined level.

3. The improvement of claim 1 further including a pair of blow-back dampers disposed in said duct respectively immediately upstream of said material burning apparatus inputs and operable by air pressure to allow air movement only in a direction into said particulate material burning apparatus.

4. A charging system for a particulate waste material burner having a steam boiler comprising:

a storage bin containing particulate waste material to be burned out and having a metered output means;

a duct for transporting said particulate waste material from said storage bin to said waste material burner;

a feed means interconnected between said storage bin and said duct for depositing said particulate material in said duct while maintaining an air-sealed relation between said storage bin and said duct;

a blower having a variable vortex input, said blower connected to said duct for producing an air stream therein for moving said deposited particulate material through said duct to said particulate material burner;

at least one blow-back damper disposed in said duct immediately upstream of said particulate material burner; and a control unit having inputs received from said particulate material burner and having outputs connected to said storage bin for metering the output thereof, to said feed means for varying the amount of discharged waste material into said duct, to said blower vortex input, for varying the volume of air fed into said duct, for control of said particulate material charging in response to said received inputs for optimum fuel-air mixture charging of said burner.

5. The charging system of claim 3 wherein said storage bin has a base with a central opening therein and said variable feed means is comprised of a radially free-sweeping, non-arching conveyor screw rotatable within said container and operable to unload stored particulate material through said opening.

6. The charging system of claim 3 wherein said storage bin has a base with a central opening therein and a hopper is disposed beneath said opening to receive particulate waste material from said storage bin and said feed means is interconnected between said hopper and said duct and comprises:

a generally cylindrical housing having an upper opening communicating with a bottom of said hopper and having a lower opening communicating with said duct;

a cylindrical shaft axially supported in said central housing for rotation therein, said shaft having a plurality of radially extending blades co-rotationally attached thereto for receiving particulate material from said upper opening and transporting said material to and depositing said material through said lower opening;

a drive means connected to said shaft for rotation thereof; and an air seal associated with each blade for preventing air flow from said duct to said hopper through said housing.

7. The charging system of claim 3 wherein a sensor is disposed in said storage bin and is connected to said control unit for providing a signal thereto in response to a sensed volume of particulate waste material therein, and wherein said control unit has a main supply switch which is closed to provide power to the charging system only when a predetermined volume is sensed by said sensor.

8. The charging system of claim 4 wherein said inputs received from said particulate waste material burner are from two sensors located in said burner which respectively measure combustion efficiency from said burner and steam demand in said boiler.

9. The charging system of claim 3 wherein said storage bin has a base with a central opening therein and a hopper is disposed beneath said opening for receiving particulate waste material from said storage bin and said hopper has a sonic sensor comprising:

a sonic transmitter and a sonic receiver mounted opposite and co-level with one another in a wall of said hopper, said transmitter providing a horizontal sonic beam to said receiver;

a sensor analyzer mounted remote from said hopper and connected to said sonic receiver, said sensor providing a signal to said control unit as long as said sonic beam is received from said sonic transmitter by said sonic receiver at a selected level and upon reception below said level provides a signal to said control unit for ceasing operation of said constant unloading means.

10. A method for charging a particulate waste material burner having a steam boiler comprising the steps of:

unloading a metered quantity of particulate waste material from a storage bin into a feed means;

depositing a controlled amount of particulate material from said feed means into a duct leading to said waste material burner;

providing a controlled air stream in said duct to transport said particulate material in said duct to said burner and supply a controlled particulate material-air mixture to said burner;

providing a feedback signal from said feed means to a control unit indicating a level of said particulate waste material in said feed means;

providing a feedback signal from said burner to said control unit indicating the combustion efficiency of said burner;

providing a feedback signal from said boiler to said control unit indicating the steam demand of said boiler;

and controlling said metered flow of particulate material, said feeding of said particulate material into said duct from said feed means and said air stream by said control unit in response to said feedback signals.

11. The charging system of claim 5 wherein each of said plurality of radially extending blades terminates in a knife edge for cutting larger particulate waste material into smaller pieces before depositing said material through said lower opening.

* * * * *

UNITED STATES PATENT AND TRADEMARK OFFICE

CERTIFICATE OF CORRECTION

PATENT NO. : 4,311,102

DATED : January 19, 1982

INVENTOR(S) : Melvin W. Kolze and Bruce A. Kolze

It is certified that error appears in the above—identified patent and that said Letters Patent is hereby corrected as shown below:

In claim 5, line 1, cancel "3" and substitute -- 4 -- therefor;

In claim 6, line 1, cancel "3" and substitute -- 4 -- therefor;

In claim 7, line 1, cancel "3" and substitute -- 4 -- therefor; and

In claim 9, line 1, cancel "3" and substitute -- 4 -- therefor.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*